United States Patent [19]

Stenger

[11] Patent Number: 4,784,299

[45] Date of Patent: Nov. 15, 1988

[54] TAP WITH SPACED PRODUCT AND GAS TUBES

[75] Inventor: Donald R. Stenger, Roscoe, Ill.

[73] Assignee: Johnson Enterprises, Inc., Rockford, Ill.

[21] Appl. No.: 34,274

[22] Filed: Apr. 3, 1987

[51] Int. Cl.[4] ..... B67D 1/12

[52] U.S. Cl. ..... 222/397; 222/400.7; 222/81

[58] Field of Search ..... 222/400.7, 400.8, 82, 222/85, 397, 80, 81, 394, 464, 478; 137/212

[56] References Cited

U.S. PATENT DOCUMENTS

| | | | |
|---|---|---|---|
| 3,379,927 | 3/1968 | Schmidt | 222/400.7 X |
| 3,545,475 | 12/1970 | Johnson, Jr. | 137/212 |
| 4,000,829 | 1/1977 | Johnson, Jr. et al. | 220/265 |
| 4,134,522 | 1/1979 | Patzke et al. | 222/400.7 X |
| 4,174,743 | 11/1979 | Beny et al. | 222/400.8 X |
| 4,436,227 | 3/1984 | Johnson, Jr. et al. | 222/382 |
| 4,699,298 | 10/1987 | Grant et al. | 222/400.7 |

*Primary Examiner*—Joseph J. Rolla
*Assistant Examiner*—Nils E. Pedersen
*Attorney, Agent, or Firm*—Leydig, Voit & Mayer, Ltd.

[57] ABSTRACT

A tap for use with a container closure of the type having a pair of resilient sealing plugs. The tap includes a body which supports spaced product and gas tubes adapted to be thrust through the resilient sealing plugs of the closure. When the tap is removed from the container, the gas tube separates from the tap body and remains in the respective sealing plug so as to vent pressure in the container safely to atmosphere. Stabilizing fins extend downwardly from the tap body and engage the top of the closure to help hold the tap in a secure vertical position on the container.

6 Claims, 2 Drawing Sheets

TAP WITH SPACED PRODUCT AND GAS TUBES

BACKGROUND OF THE INVENTION

This invention relates to a tap for dispensing product from a container. More particularly, the invention relates to a tap for use with a disposable plastic-like container having a closure of the same general type as disclosed in Johnson, Jr. et al U.S. Pat. No. 4,000,829.

The closure disclosed in the aforementioned patent comprises a pair of resilient sealing plugs each having a bore which is initially sealed by a membrane. The tap for use with the closure compises a body which supports a relatively long product tube and a significantly shorter gas tube. The product tube is adapted to dispense a product (e.g., a beverage) from the container while the gas tube is adapted to deliver pressurized gas into the container for the purpose of forcing the product to flow through the product tube.

In use, the two tubes are telescoped downwardly into the sealing plugs and, as an incident thereto, puncture the membranes. At the same time, the tubes open flapper valves formed on and hinged to the lower ends of the sealing plugs and normally biased against the membranes. The punctured membranes seal against the outer sides of the tubes and prevent the product from leaking out of the container along the outer sides of the tubes while the tap is in use.

When a conventional tap is removed from the container, the pressure in the container causes the flappers to immediately swing to positions sealing the punctured membranes and tightly closing the container. If the container is disposable, a potentially dangerous situation could be created if the container is left in a pressurized condition and is subjected to heat (e.g., direct sunlight). Under such conditions, the pressure could increase to such a high magnitude as to cause the container to explode.

SUMMARY OF THE INVENTION

The general aim of the present invention is to provide a new and improved tap which automatically relieves the pressure in the container as an incident to the tap body being removed from the container thereby to guard against pressure build up in the container.

A more detailed object of the invention is to achieve the foregoing by providing a tap in which the tap body automatically separates from the gas tube and leaves the gas tube in its sealing plug when the tap body is removed from the container. As a result of the gas tube remaining in the sealing tube, residual pressure in the container is vented through the gas tube. Thereafter, the gas tube is removed from the plug and is re-assembled with the tap body so as to enable re-use of the tap.

A further object of the invention is to provide means for insuring that the gas tube is oriented in a proper angular position relative to the tap body when the tube is re-assembled with the body.

The invention also resides in the provision of novel means on the tap body for stabilizing the tap in an upright position on the container.

These and other objects and advantages of the invention will become more apparent from the following detailed description when taken in conjunction with the accompanying drawings.

BRIEF DESCRIPTION OF THE DRAWINGS

FIG. 6 being on a reduced scale.

DETAILED DESCRIPTION OF THE PREFERRED EMBODIMENT

Figure 1:
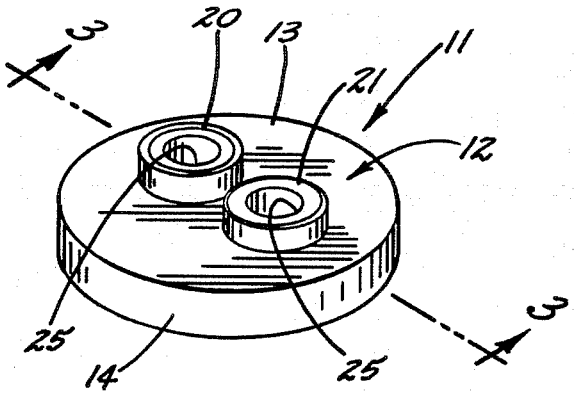
FIG. 1 is a perspective view of a typical closure adapted for use with a unique tap incorporating the new and improved features of the present invention.
Figure 2:
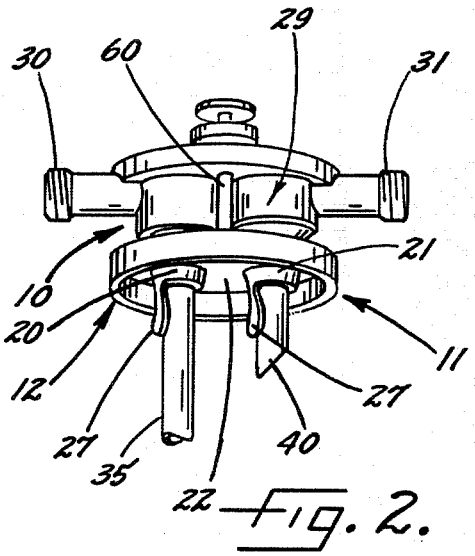
FIG. 2 is a perspective view of the tap and the closure and shows the tap in an installed position relative to the closure.

The tap 10 of the present invention is particularly adapted for use in conjunction with a container closure 11 which, for all practical purposes, is identical to the closure disclosed in Johnson, Jr. et al U.S. Pat. No. 4,000,829. Such a closure comprises a metal overcap 12 having a top plate 13 and a depending skirt 14. The overcap is adapted to be placed over the neck 15 of a container 16 and the skirt is adapted to be crimped beneath a lip 17 on the neck in order to hold the overcap securely on the neck. In this particular instance, the container 16 is a disposable container made of polyethylene terephthalate or other plastic-like material. Specifically, the container may be a spherical container of the type sold by the assignee of the present invention under the trademark BEER SPHERE.

Figure 3:
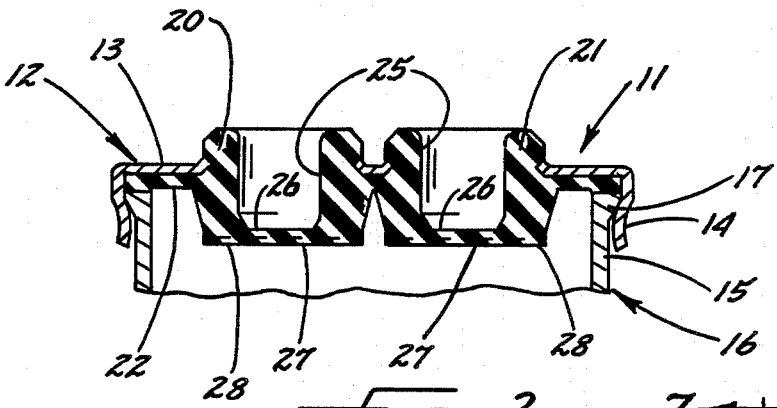
FIG. 3 is an enlarged fragmentary cross-section taken substantially along the line 3—3 of FIG. 1.

In addition to the overcap 12, the closure 11 includes a pair of side-by-side sealing plugs 20 and 21 located within holes in the top plate 13 of the overcap. The sealing plugs are made of rubber and are molded integrally with a disc-like gasket 22 (FIG. 3) which underlies the top plate 13. When the overcap 11 is installed on the neck 15 of the container 16, the outer peripheral portion of the gasket becomes sandwiched between the top plate 13 and the top of the lip 17 so as to establish a seal between the two.

Each sealing plug 20 and 21 is formed with an upwardly opening bore 25 (FIG. 3) whose lower end is originally sealed by a relatively thin membrane 26 which is molded integrally with the plug. Underlying each membrane is a flapper 27 which also is molded integrally with the plug. Each flapper is connected to its respective plug to swing upwardly and downwardly about an integral hinge section 28 spaced radially from the bore 25 and disposed in substantially the same plane as the membrane 26. When the closure 11 is installed on the container 16, any integral pressure in the container will force the flappers 27 upwardly into face-to-face relation with the membranes 26 (see FIG. 3). Also, the memory of the rubber tends to urge the flappers upwardly. In the event one of the membranes should be accidently punctured, the associated flapper will maintain a seal at the bottom of the plug.

The tap 10 includes a body 29 molded of plastic and having a fitting 30 adapted to be connected to a product dispensing line such as a beer line (not shown). The tap body also includes a second fitting 31 adapted to be connected to a source of pressurized gas such as a cylinder (not shown) of $CO_2$. Formed in the body are internal passages 32 and 33 (FIG. 4) which define product and gas passages, respectively.

A relatively long product tube 35 (FIGS. 4 and 5) for dispensing product is inserted into a hole 36 in the tap body 29 and communicates with the passage 32. The product tube is preferably made of plastic and is attached very securely to the body by a coupling 37.

Figure 6:
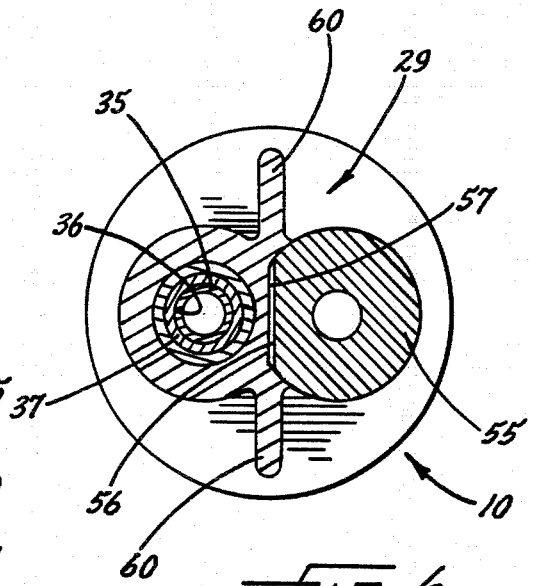
FIGS. 6 and 7 are fragmentary cross-sections taken substantially along the lines 6—6 and 7—7, respectively, of FIG. 4.

Spaced from the product or beer tube 35 is a plastic gas tube 40 which communicates with the gas passage 33. The axes of the two tubes lie on a common imaginary circle and are spaced diametrically from one another around the circle (see FIG. 6). The gas tube is significantly shorter than the beer tube 35 and its lower end portion is beveled on an acute angle as indicated at 41 in FIG. 4 so as to form a point 42 on one side of the tube at the extreme lower end thereof. A similar point (not shown) is formed on the lower end of the beer tube 35.

Figure 4:
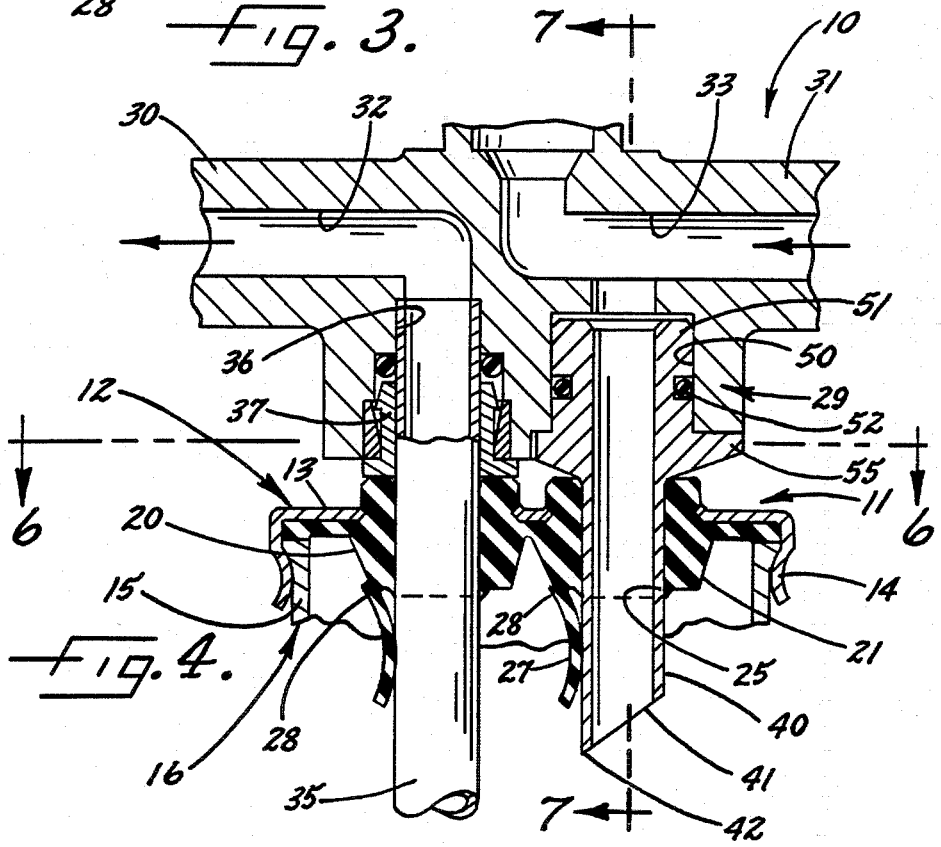
FIG. 4 is a fragmentary cross-section similar to FIG. 3 but shows the tap in an installed position relative to the closure.
Figure 5:
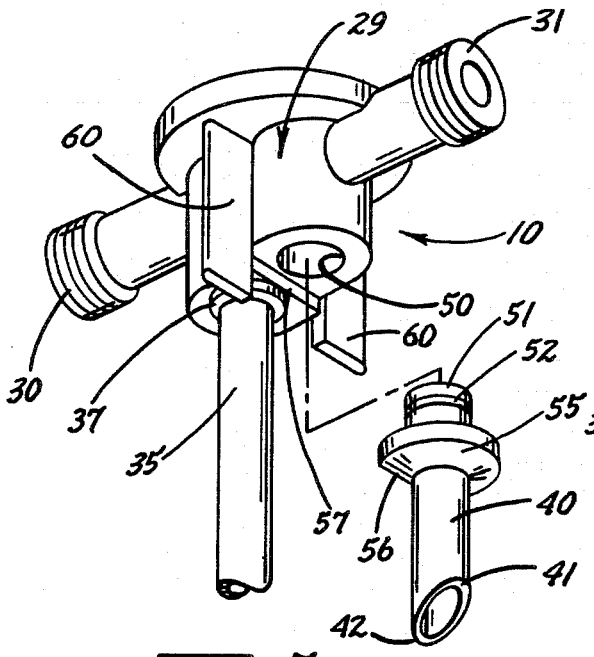
FIG. 5 is an exploded perspective view of the tap and the gas tube.

During installation, the tap 10 is positioned such that the tubes 35 and 40 are alined with the bores 25 in the sealing plugs 20 and 21. The tap then is thrust downwardly to cause the tubes to enter the bores and to cause the pointed lower ends of the tubes to pierce the membranes 26. Downward movement of the tap is continued until the tap is stopped by the sealing plugs 20 and 21. At this time, the lower end of the beer tube 35 is located closely adjacent the extreme bottom of the container 16 while the lower end of the gas tube 40 is located adjacent the lower end of the neck 15 (see FIG. 4). The material of the punctured membranes 26 folds downwardly alongside and seals against the outer sides of the tubes and, as shown in FIG. 4, the flappers 27 are held open by the tubes.

With the arrangement as described thus far, gas is delivered into the container 16 via the fitting 31, the passage 33 and the gas tube 40 and serves to pressurize the container so as to cause beer or other product to flow out of the container by way of the tube 35, the passage 32 and the fitting 30. When the container 16 is empty, the tap 10 is removed from the container and the container is discarded. When the tubes are withdrawn from the plugs 20 and 21, the flappers 27 swing toward their closed positions against the punctured membranes 26.

Figure 8:
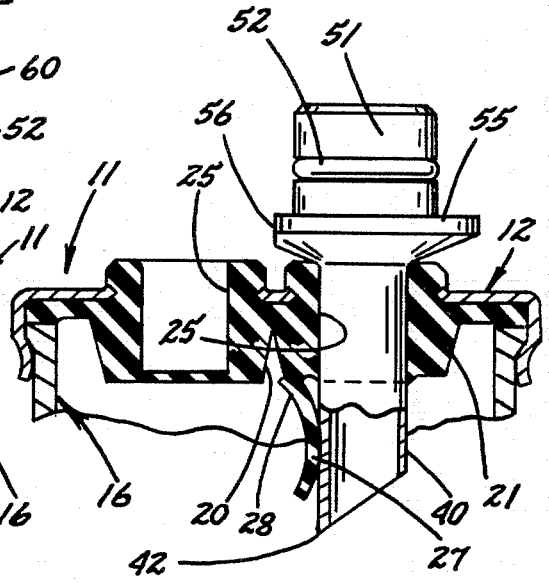
FIG. 8 is a view similar to FIG. 4 but shows the tap body removed from the container with the gas tube remaining in place in one of the sealing plugs of the closure.

In accordance with the primary aspect of the present invention, the gas tube 40 is connected to the tap body 29 in such a manner that, when the tap body is pulled away from the container 16, the gas tube automatically separates from the body and remains in the bore 25 of the sealing plug 21 (see FIG. 8). As a result, the gas tube holds the flapper 27 of the plug 21 open and, in this way, enables residual pressure in the container to vent to atmosphere through the gas tube. Accordingly, the container is de-pressurized so that, when the container is discarded, there is little danger of heat causing pressure to build up in the container and causing the container to explode.

Figure 7:
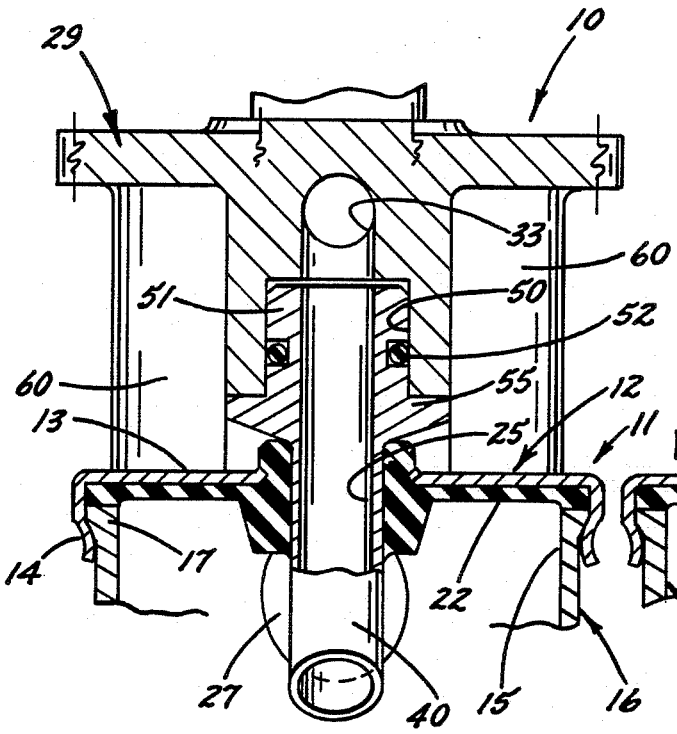

To achieve the foregoing, the tap body 29 is formed with a cylindrical and downwardly opening socket 50 (FIGS. 5 and 7) which communicates with the gas passage 33. An enlarged sleeve 51 is molded integrally with the upper end of the gas tube 40 and is telescoped into the socket 50. An O-ring 52 is contracted in a circumferentially extending groove in the sleeve 51 and establishes a seal against the wall of the socket 50. The O-ring engages the wall of the socket 50 with sufficient friction to retain the sleeve 51 in the socket but permits the sleeve to separate axially from the socket when opposing axial forces are exerted on the tap body 29 and the gas tube 40.

When the gas tube 40 is in its normal position in the sealing plug 21 as shown in FIG. 4, the resilient wall of the bore 25 and the resilient material of the membrane 26 grip the gas tube radially with significant force. Accordingly, when the tap body 29 is pulled away from the container 16, the gas tube 40 remains stationary. As a result, the socket 50 pulls off of the sleeve 51 so as to leave the gas tube and the sleeve in place as shown in FIG. 8 and thereby enable pressure in the container to vent to atmosphere through the tube and sleeve. It only takes a few seconds to vent the container and, once venting has taken place, the gas tube 40 may be pulled out of the plug 21 and the sleeve 51 may be telescoped back into the socket 50 to enable the tap 10 to be reused.

To facilitate pulling the gas tube 40 out of the plug 21, an enlarged radial flange 55 (FIG. 8) is formed integrally with the gas tube at the junction of the tube with the sleeve 51. The flange defines a finger grip which may be used to pull upwardly on the gas tube 40.

The flange 55 also is used to cause the gas tube 40 to be oriented angularly such that the point 42 thereof is located adjacent the hinge 28 of the sealing plug 21. For this purpose, the periphery of the flange 55 is circular except for a relatively short portion 56 (FIGS. 5 and 6) which is flat and which extends across a chord of the circle defined by the remainder of the flange. The flat 56 is adapted to mate with a flat portion 57 formed on the tap body 29 at a location adjacent the socket 50. It is not possible to telescope the sleeve 51 into the socket 50 unless the gas tube 40 is oriented angularly such that the flat 56 faces the shoulder 57. When the tube is so oriented, the point 42 is located adjacent the hinge 28 of the plug 21 and cleanly punches through the membrane 26 rather than severing the membrane from the plug. Thus, the flat 56 on the flange 55 coacts with the shoulder 57 to insure proper angular orientation of the gas tube 40 when the tube is re-assembled with the tap body 29.

The tap body 29 also includes unique means for stabilizing the tap 10 on the closure 11. Herein, these means comprise a pair of vertically extending and diametrically spaced fins 60 (FIGS. 5 to 7) which are molded integrally with the tap body 29. Each fin is of substantial radial width and extends a predetermined distance below the lower end of the body. Also, each fin is spaced approximately ninety degrees from each of the tubes 35 and 40 around the aforementioned imaginary circle containing the axes of the tubes (see FIG. 6).

When the tap 10 is installed on the closure 11, the lower end of the collar 37 and the lower end of the flange 55 engage the upper ends of the plugs 20 and 21, respectively, so as to stabilize the tap at two diametrically spaced locations. In addition, the lower ends of the fins 60 engage the top plate 13 of the overcap 12 at two additional diametrically spaced locations each spaced ninety degrees from each of the first locations. As a result, the tap 10 is supported at four angularly spaced locations so as to keep the tap from rocking and working out of the plugs 20 and 21 under pressure and also to keep the beer tube 35 perpendicular to the closure 11 in order to allow the beer tube to reach to maximum depth in the container 16.

I claim:

1. A tap for dispensing a product from a container, said tap comprising a body having a product passage and a gas passage, said body having a socket which communicates with said gas passage, a relatively long product tube fastened securely to said body and communicating with said product passage to dispense product from said container, a substantially shorter gas tube communicating with said gas passage for delivering pressurized gas into said container for the purpose of forcing product to flow through said product tube, said gas tube having one end portion telescoped slidably with said socket and being releasable therefrom when said gas tube is held axially stationary and said body is pulled axially away from said gas tube, the opposite free end portion of said gas tube being beveled at an acute angle relative to the axis of the gas tube so as to cause a point to exist at one said of the free end of the gas tube, and coacting means on said gas tube and said body and engageable with one another to orient said gas tube in a predetermined angular position in said socket thereby to cause said point to be oriented in a predetermined angular position relative to said body.

2. A tap as defined in claim 1 in which the axes of said product tube and said gas tube lie on a common imaginary circle, the axis of said product tube being spaced approximately 180 degrees around said circle from the axis of said gas tube, and a pair of stabilizers projecting from said body and spaced diametrically from one another around said circle, each of said stabilizers being spaced approximately 90 degrees from the axes of said tubes as measured around said circle.

3. A tap for dispensing a product from a container, said tap comprising a body having a lower end and having non-coaxial product and gas passages, a relatively long product tube fastened securely to and depending from said body and communicating with said product passage to dispense product from said container, a downwardly opening socket formed in the lower end of said body and communicating with said gas passage, said socket being spaced from said product tube, an upright gas tube having a length substantially less than the length of said product tube, a radially extendinf flange at the upper end portion of said gas tube, said gas tube communicating with said gas passage and being adapted to deliver pressurized gas into said container for the purpose of forcing product to flow upwardly through said product tube, said gas tube being telescoped slidably into said socket with a friction fit which is sufficiently loose to permit said socket to be pulled upwardly out of telescoping relation with said gas tube when the gas tube is held axially stationary and the body is pulled upwardly away from the gas tube.

4. A tap as defined in claim 3 in which the lower end portion of said gas tube is beveled at an acute angle relative to the axis of the gas tube so as to cause a point to exist at one side of the lower end of the gas tube, and flat portions on said flange and said body and engageable with one another to orient said gas tube in a predetermined angular position in said socket thereby to cause said point to be oriented in a predetermined angular position relative to said body.

5. A tap for dispensing a product from a container, said tap comprising a body having a lower end and having non-coaxial product and gas passages, a product tube fastened to and depending from said body and communicating with said product passage to dispense product from said container, an upright gas tube depending from said body and communicating with said gas passage for delivering pressurized gas into said container for the purpose of forcing product to flow upwardly through said product tube, the axes of said product tube and said gas tube lying on a common circle, said product tube and said gas tube being spaced approximately 180 degrees from one another around said circle, and a pair of diametrically spaced stabilizers projecting downwardly from said body beyond the lower end thereof and each spaced approximately 90 degrees from the axis of said tubes as measured around said circle.

6. A tap as defined in claim 5 further including a downwardly opening socket in said body and communicating with said gas passage, the upper end portion of said gas tube being telescoped slidably into said socket with a friction fit which is sufficiently loose to permit said socket to be pulled upwardly out of telescoping relation with said gas tube when the gas tube is held axially stationary and the body is pulled upwardly away from the gas tube.

* * * * *